United States Patent [19]

Mikami et al.

[11] 4,279,290

[45] Jul. 21, 1981

[54] DEVICE FOR DETECTING GATES IN AN AUTOMATIC POURING MACHINE FOR CASTING

[75] Inventors: Teigo Mikami; Hiroaki Miyano; Masahide Kosugi, all of Toyota, Japan

[73] Assignee: Toyota Jidosha Kogyo Kabushiki Kaisha, Toyota, Japan

[21] Appl. No.: 109,047

[22] Filed: Jan. 2, 1980

[30] Foreign Application Priority Data

May 15, 1979 [JP] Japan ..... 54/59910

[51] Int. Cl.[3] ..... B22D 35/04

[52] U.S. Cl. ..... 164/154; 164/157; 141/284

[58] Field of Search ..... 164/4, 154, 155, 157; 141/157, 284

[56] References Cited

FOREIGN PATENT DOCUMENTS 49-13699 4/1974 Japan ..... 164/154

54-136362 10/1979 Japan ..... 164/155

*Primary Examiner*—Robert D. Baldwin

*Attorney, Agent, or Firm*—Oblon, Fisher, Spivak, McClelland & Maier

[57] ABSTRACT

A device for detecting a gate in an automatic pouring machine for casting which is located in the vicinity of a horizontal pouring line provided thereon with a plurality of adjacently placed molds intermittently conveyed in one direction and which has a pouring trough provided with a spout for pouring molten metal into the gate of each of the molds and horizontally swingable by a vertical pivot. The device comprises a means provided in each mold to indicate the position of the gate, an arm horizontally swingably mounted by a vertical pivot which is symmetrically placed against the pivot of the trough with respect to the pouring line, a pair of slits provided in ends of the arm and the trough which are opposite with each other upon linear alignment of the arm and the trough, a connecting pin slidably engaged in the slits to move along a perpendicular bisector on a line connecting the two pivots with each other and a photoelectric switch provided in the arm to detect the means for indicating the position of the gate. The distance between the photoelectric switch and the connecting pin becomes identical with that between the connecting pin and the spout of the trough upon linear alignment of the arm and the trough, and a driving means for moving the connecting pin operates upon receipt of a signal from the photoelectric switch to swingingly move the trough and the arm so that the spout is aligned with the gate for certain pouring operation.

7 Claims, 10 Drawing Figures

DEVICE FOR DETECTING GATES IN AN AUTOMATIC POURING MACHINE FOR CASTING

BACKGROUND OF THE INVENTION

1. Field of the Invention

The present invention relates to a device for detecting gates in an automatic pouring machine for casting which successively pours molten metal into a plurality of molds located on a pouring line to be intermittently conveyed therealong through a pouring trough extending above and across the pouring line to be horizontally swingable along the direction of the pouring line. More particularly, it relates to a device for detecting gates by swingingly moving the pouring trough horizontally along the pouring line to align a pouring spout provided in the trough with the gate of a mold to be poured in the pouring operation.

2. Description of the Prior Art

When successively pouring molten metal into a plurality of molds conveyed along pouring line utilizing an automatic pouring machine, it is necessary to completely align the spout of the pouring machine with the gate of the mold to be poured. However, in case of molds produced by a type molding machine utilizing no flasks, there sometimes occurs displacement between the spout of the pouring machine and the gate of the mold because of possible variations in spaces between each two gates since the molds tend to vary in thickness, i.e., in size in the direction of the pouring line depending on the quality of the sand and changes in the pressure in molding.

Therefore, it is necessary to confirm alignment of the spout and the gate previous to pouring operation, and when the gate is out of place, it should be properly located by detection of the position thereof.

In the conventional device, thus, an operator observes the pouring operation through a television, and when displacement occurs between the spout and the gate, a trough swingably provided in the pouring machine is driven by a push button to swingingly move in the longitudinal direction of the pouring line for proper alignment of the spout provided in the trough and the gate of the mold. However, such a device requires the operator prodigious labor and technical skill, and further, there is the possibility of overflow of the molten metal by erroneous operation.

SUMMARY OF THE INVENTION

An object of the present invention is to provide a device for detecting gates in an automatic pouring machine for casting, which can automatically align the pouring spout of a pouring trough with each of the gates of molds intermittently conveyed along a pouring line without necessity of observation by an operator in a direct manner or through a television.

Another object of the present invention is to provide a device for detecting gates in an automatic pouring machine for casting, which can automatically and certainly align the pouring spout of the pouring trough with each of the gates of molds intermittently conveyed along a pouring line regardless of variations of the molds in size.

Still another object of the present invention is to provide a device for detecting gates in an automatic pouring machine for casting, which can accurately detect the position of each gate while always maintaining specific relation between the position of the pouring spout and a means indicating the position of each gate.

DESCRIPTION OF THE PREFERRED EMBODIMENT

Figure 1:
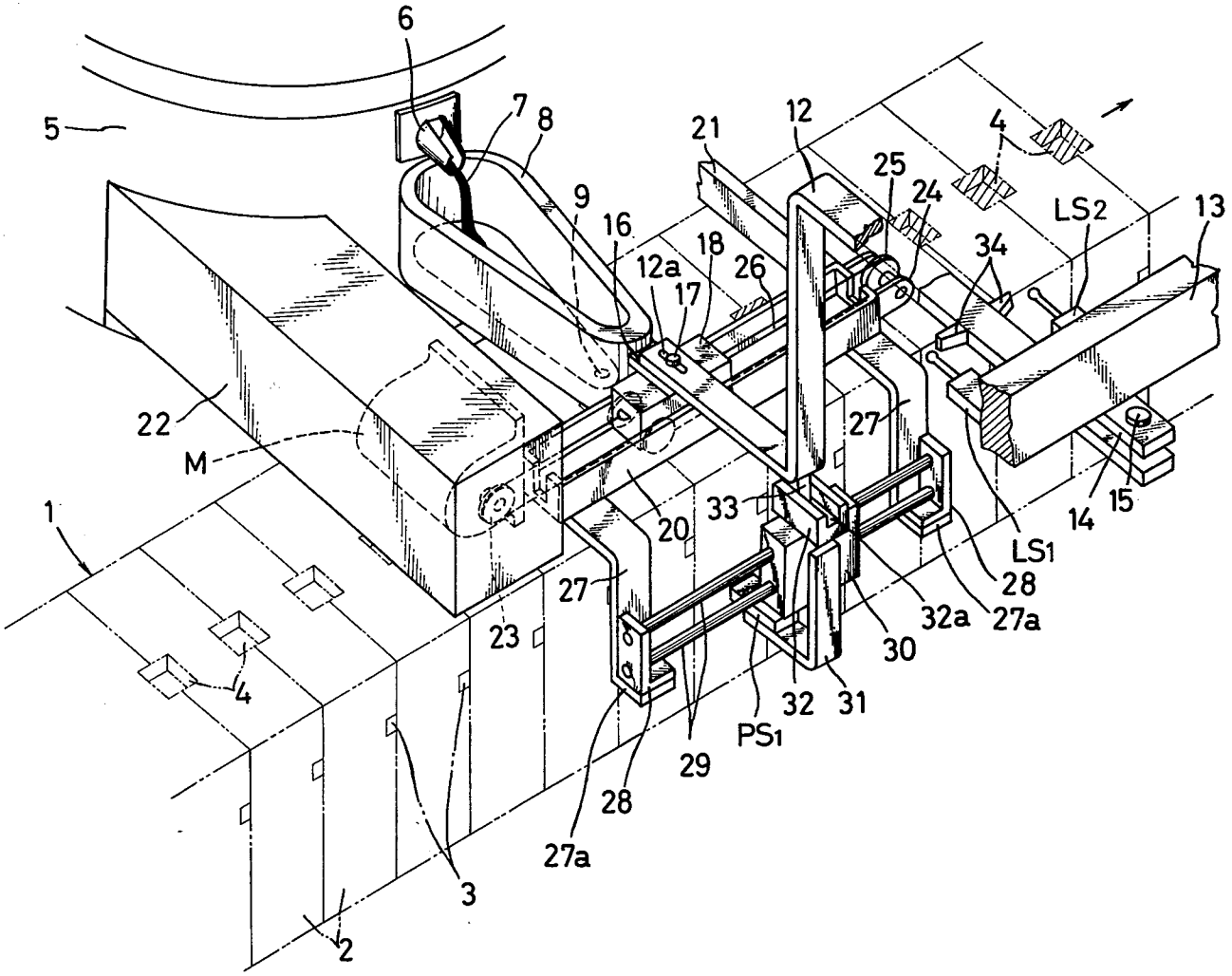
FIG. 1 is a perspective view showing an embodiment of the device according to the present invention.

Referring now to FIG. 1 of the drawings, numeral 1 indicates a horizontal pouring line along which a plurality of molds 2 having no flasks produced by a molding machine are intermittently conveyed in the direction of an arrow shown in FIG. 1 at a certain pitch by an appropriate conveyer. Each mold 2 has in one end of its contact surface a recess 3 corresponding to each gate 4 to indicate the position thereof. The recess 3 is formed simultaneously with production of the mold 2.

The body 5 of an automatic pouring machine is provided to face one side of the pouring line 1. The body 5 is provided with a trough 8 which receives molten metal 7 extruded from an outlet 6 at certain intervals and feeds the same into the gate 4 of the mold 2. The trough 8 is horizontally or somewhat downwardly inclingly extending from the body 5 above and across the pouring line 1 so that a pouring spout 9 provided in its forward end vertically aligns with a line connecting each gate 4 of each mold 2 along the pouring line 1. The trough 8 is connected at its end opposite to the spout 9 by a rotatable vertical pin 11 to a bracket 10 which is secured to the body 5, and is horizontally swingable along the direction of the pouring line 1 so that the position of the spout 9 can be changed to correspond to displacement of the gate 4 (see FIG. 2).

A supporting arm 12 for a detector is provided horizontally opposite to the trough 8. The supporting arm 12 is bent in a crank-shaped form, and the rear end thereof is supported through a vertical pin 15 by a bracket 14 which is secured to a portion of an overhead beam 13 so that it is horizontally swingable while the forward end thereof is connected to the trough 8 so that its swinging movement corresponds to that of the trough 8. An arm 16 having a longitudinal slit 16*a* extends from the forward end of the trough 8, which is superposed with the supporting arm 12 so that the slit 16*a* is aligned with a longitudinal slit 12*a* provided in the forward end of the supporting arm 12. A connecting pin 17 is slidably inserted into the slits 12*a* and 16*a* to connect the arms 12 and 16 with each other. The connecting pin 17 is placed in the intermediate position between the vertical pins 11 and 15. Namely, the connecting pin 17 is positioned to equalize the distance A from the vertical pin 11 which is a supporting point of the trough 8 with the distance A′ from the vertical pin 15 which is a supporting point of the supporting arm 12, and thus the swinging angle of the trough 8 is always maintained identical with that of the supporting arm 12.

The connecting pin 17 additionally functions as a driving pin to make the trough 8 and the supporting arm 12 swing, and is mounted on a travelling chassis 18. The travelling chassis 18 is movably placed through rollers 19 on a guide rail 20 which is provided in parallel with the pouring line 1 and channel-shaped in cross section. The guide rail 20 is secured at its one end to an appropriate frame 21 forming a portion of the pouring machine and at its other end to a motor box 22. The motor box 22 is provided directly above the pouring line 1 and is secured at one end to the body 5. The motor box 22 contains a reversible driving motor M having a speed reducer, and a chain 26 secured at one end to the forward end and at the other end to the rear end of the travelling chassis 18 passes around a sprocket wheel 23 driven by the driving motor M and another sprocket wheel 25 mounted through a bearing 24 to the guide rail 20 at the end opposite to the driving motor M. Thus, horizontal swinging movement of the trough 8 and the supporting arm 16 in the forward or backward direction is achieved by forward or backward movement of the travelling chassis 18 along the guide rail 20 through the chain 26 following normal rotation or reversion of the driving motor M, which is controlled by electrical signals from a detector PS1 which is hereinafter described, only when the gate 4 of the mold 2 is displaced from the position aligning with the spout 9 of the trough 8.

A pair of supporting plates 27 are secured to both ends of the lower surface of the guide rail 20 at one ends respectively. Each supporting plate 27 extends in parallel with the supporting arm 12 and is bent in a crank-shaped form, and the forward end thereof is placed to be opposite to the side surface of the mold 2. An L-shaped supporter 28 is securely provided on a horizontal portion 27*a* at the forward end of each supporting plate 27, and a pair of guide bars 29 are placed in a vertically-spaced relation between the two supporters 28 in parallel with the pouring line 1. A detector guiding block 30 is slidably mounted to the guide bars 29, which is provided through an L-shaped detector holder 31 with a reflex photoelectric switch PS1 for detecting the position of the gate 4 of the mold 2. The detector PS1 is adjusted to be on a level with the recess 3 indicating the position of the gate 4. The detector guiding block 30 is provided on its upper surface with a coupler 32 having a longitudinal groove 32*a* which is perpendicular to the pouring line 1 in its upper portion. The longitudinal groove 32*a* of the coupler 32 is engaged by a guide pin 33 downwardly extending from the lower bent portion of the supporting arm 12. Therefore, when the supporting arm 12 is horizontally swung, the detector PS1 moves with the detector guiding block 30 linearly and horizontally along the guide bars 29 following circular motion of the guide pin 33 of the supporting arm 12. Thus, the guide pin 33 is positioned so that the distance B between the connecting pin 17 for the trough 8 and the supporting arm 12 and the spout 9 becomes equal to the distance B′ between the connecting pin 17 and the guide pin 33. By virture of this relation between the distances B and B′ and the aforementioned relation between the distances A and A′, the spout 9 and the detector PS1 are in a line which is parallel with a line connecting the pins 11 and 15, i.e., the supporting points for swinging movement of the trough 8 and the supporting arm 12, and this relationship between the spout 9 and the detector PS1 is always maintained along the pouring line 1. The overhead beam 13 has a pair of limit switches LS1 and LS2 symmetrically provided about the supporting arm 12 to limit the end of swinging movement of the trough 8. The limit switches LS1 and LS2 are driven by a pair of dogs 34 mounted to the supporting arm 12.

Figure 2:
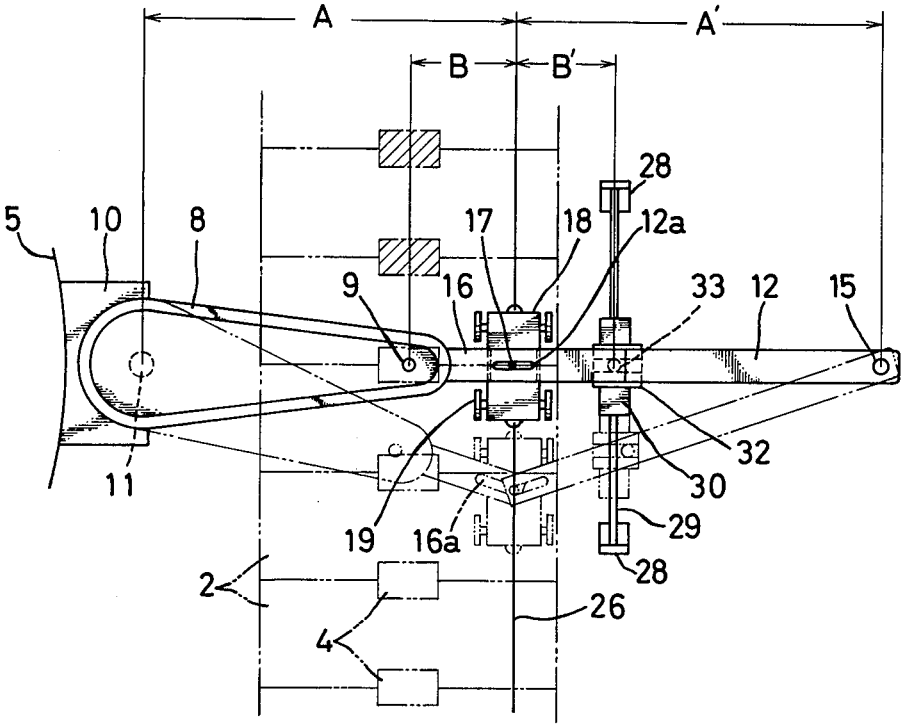
FIG. 2 is a top plan view showing an essential portion of the device of FIG. 1.
Figure 3:
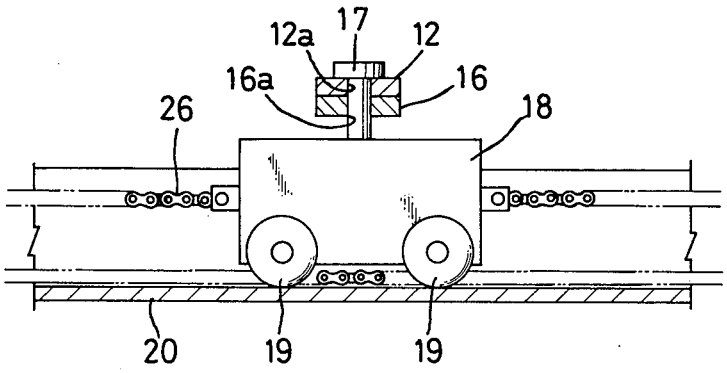
FIG. 3 is a partially fragmentary side elevational view showing the travelling chassis, the trough and the supporting arm.
Figure 4A:
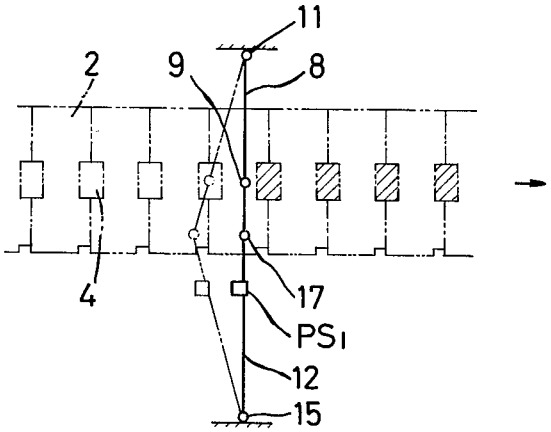
FIGS. 4(*a*), (*b*) and (*c*) are illustrative views showing operation in detecting the gate respectively.
Figure 4B:
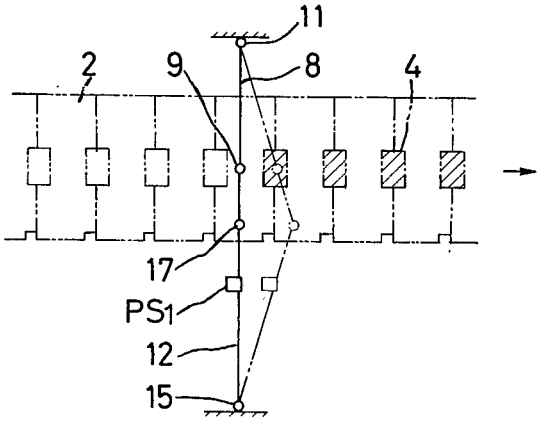
Figure 4C:
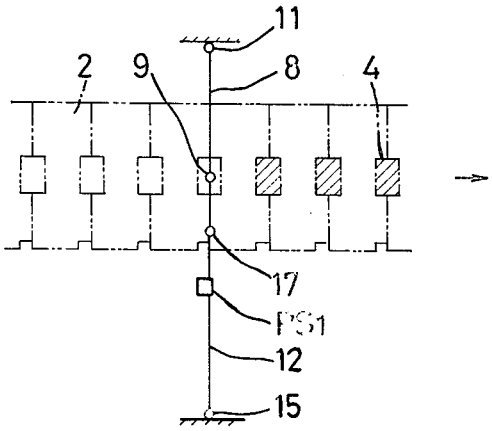

Description will now be made with respect to operation of the device according to the present invention. In the drawings, hatched gates 4 indicate those already poured with molten metal, and blank gates 4 indicate those to be poured. In FIGS. 1 and 2, pouring of molten metal into the mold 2 under the spout 9 is completed, and when the molds 2 are conveyed by one pitch by the conveyer in the direction of the arrow in FIG. 1 in this condition, the recess 3 for indicating the position of the gate 4 and the detector PS1 show relative displacement as illustrated at (a), (b) and (c) in FIG. 4 since the spaces between the gates 4 are not necessarily uniform as hereinabove described. In FIG. 4(*a*), the subject gate 4 has not reached the appropriate pouring position, and in this case, the driving motor M is normally rotated so that the trough 8 and the supporting arm 12 are swung through the travelling chassis 18 rearwardly, i.e., in the left-hand direction in FIG. 4 as shown by phantom lines, leading to horizontal rearward movement of the detector PS1. Upon detection of the recess 3 by the detector PS1, the driving motor M is stopped. In FIG. 4(*b*), the subject gate 4 has gone past the appropriate pouring position, and in this case, the driving motor M is reversely rotated so that the trough 8 and the supporting arm 12 are swung through the travelling chassis 18 forwardly as shown by phantom lines, leading to forward movement of the detector PS1, and upon detection of the recess 3 by the detector PS1, the driving motor M is stopped. Thus, even when the gate 4 of the mold 2 to be poured moves out of the appropriate pouring position, it can easily be aligned with the spout 9 of the trough 8 by detecting the recess 3 in the aforementioned manner. In FIG. 4(*c*), the subject gate 4 is properly aligned with the spout 9.

The automatic pouring machine is in practice directed to start pouring while the molds 2 are conveyed by the conveyer, and the molten metal 7 is passed through the trough 8 to the spout 9 simultaneously with completion of or just after every one pitch conveyance of the mold 2. Namely, the machine can be adjusted so that the molten metal 7 flows from the spout 9 down into the gate 4 of the mold 2 simultaneously with completion of one pitch conveyance of the mold 2, leading to improvement in working efficiency of the line eliminating or saving ineffective waiting time. The aforementioned detection is started simultaneously with completion of conveyance of the mold 2, though, displacement of the gate 4 from the spout 9 is not so large that it is entirely out of position, but the center thereof deviates from the center of the spout 9. Therefore, if the molten metal 7 flows down from the spout 9 simultaneously with starting of the detecting operation, it will not fall out of the gate 4 of the mold 2. When accumulation of displacement of the gates 4 from an initial set position with respect to the spout 9 exceeds a predetermined amount, namely, when the trough 8 and the supporting arm 12 drive the limit switch LS1 and LS2 subsequent to repeated detection of the gates 4, the driving motor M is temporarily stopped by the limit switch LS1 or LS2, leading to inching operation of the trough 8 and the supporting arm 12.

Attention is now drawn to FIGS. 5 to 8 of the drawings, with which electric control of the aforementioned detecting operation and accompanying operations are hereinafter described in detail.

Detection of the gate 4 is conducted in the following seven cases depending on the degree of deviation between the positions of the recess 3 and the photoelectric switch PS1 upon completion of one pitch conveyance of the mold 2:

I. when the photoelectric switch PS1 detects the recess 3 upon completion of one pitch conveyance of the mold 2;

II. when the photoelectric switch PS1 detects the recess 3 before operation of the limit switch LS1 by virture of rearward movement of the detector guiding block 30 and the trough 8 in the left hand direction in FIG. 1 caused by the motor M because the recess 3 is not detected by the photoelectric switch PS1 upon completion of one pitch conveyance of the mold 2;

III. when the photoelectric switch PS1 detects the recess 3 before a predetermined time period after operation of the limit switch LS1 in the aforementioned case II;

IV. when the photoelectric switch PS1 cannot detect the recess 3 even after a predetermined time period upon operation of the limit switch LS1 in the aforementioned case III;

V. when the photoelectric switch PS1 detects the recess 3 before operation of the limit switch LS2 by virtue of forward movement of the detector guiding block 30 and the trough 8 in the right hand direction in FIG. 1 caused by the motor M because the recess 3 goes past the photoelectric switch PS1 upon completion of one pitch conveyance of the mold 2;

VI. when the photoelectric switch PS1 detects the recess 3 before a predetermined time period after operation of the limit switch LS2 in the aforementioned case V; and VII. when the photoelectric switch PS1 cannot detect the recess 3 even after a predetermined time period upon operation of the limit switch LS2 in the aforementioned case VI.

Figure 5A:
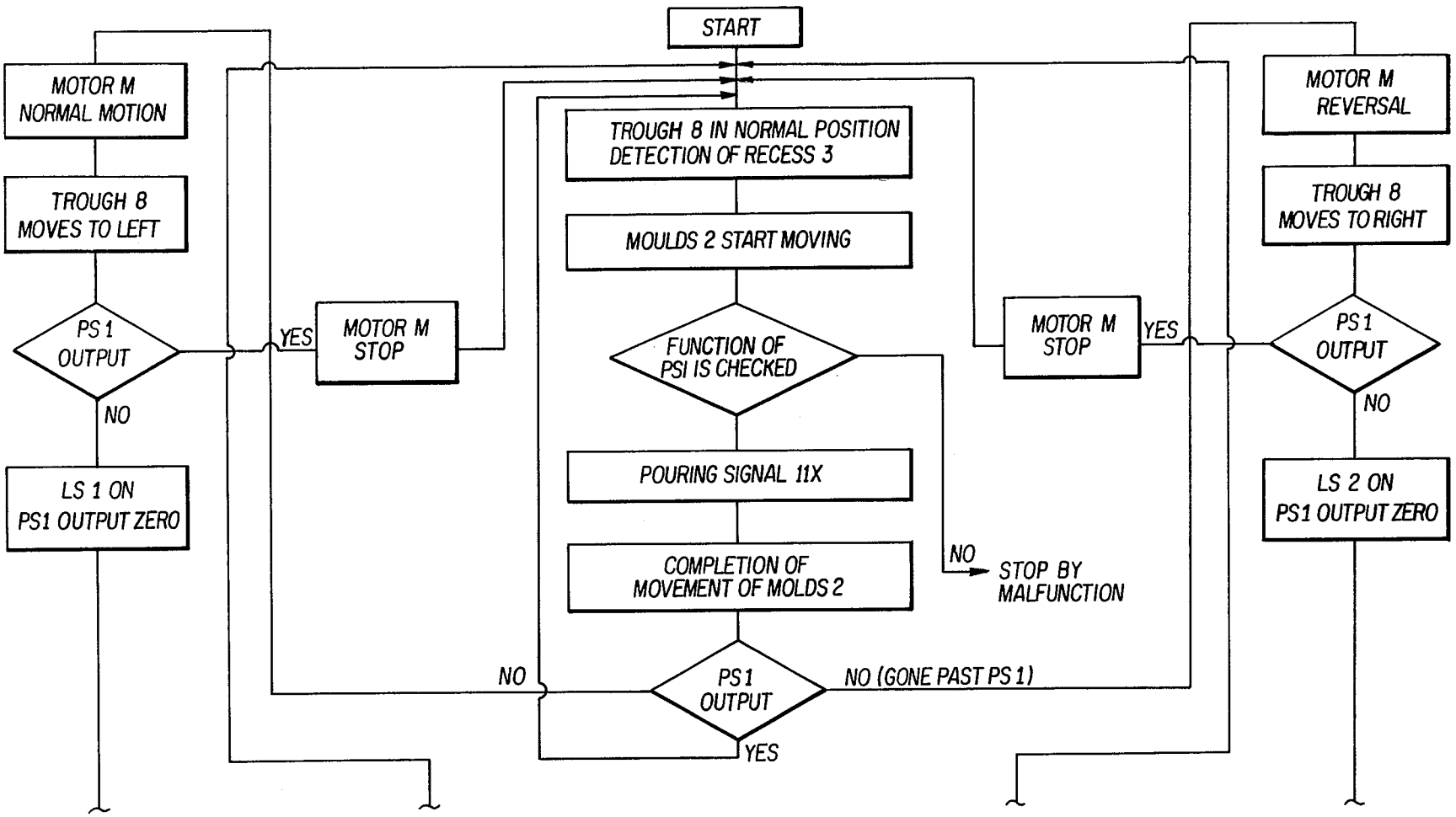
FIG. 5 is an illustrative view showing operation in detecting the gate in a flow chart.
Figure 5B:
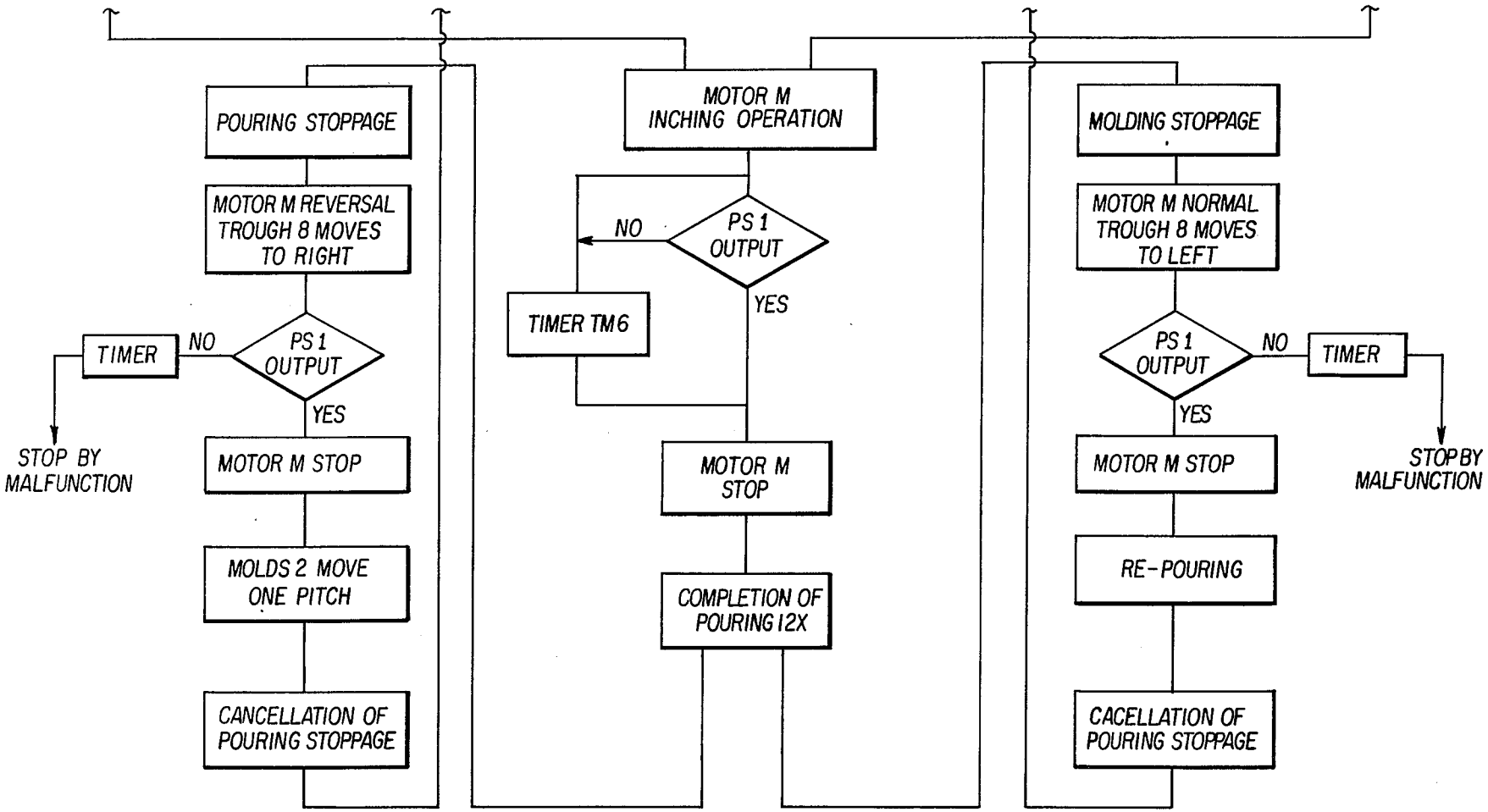
Figure 6A:
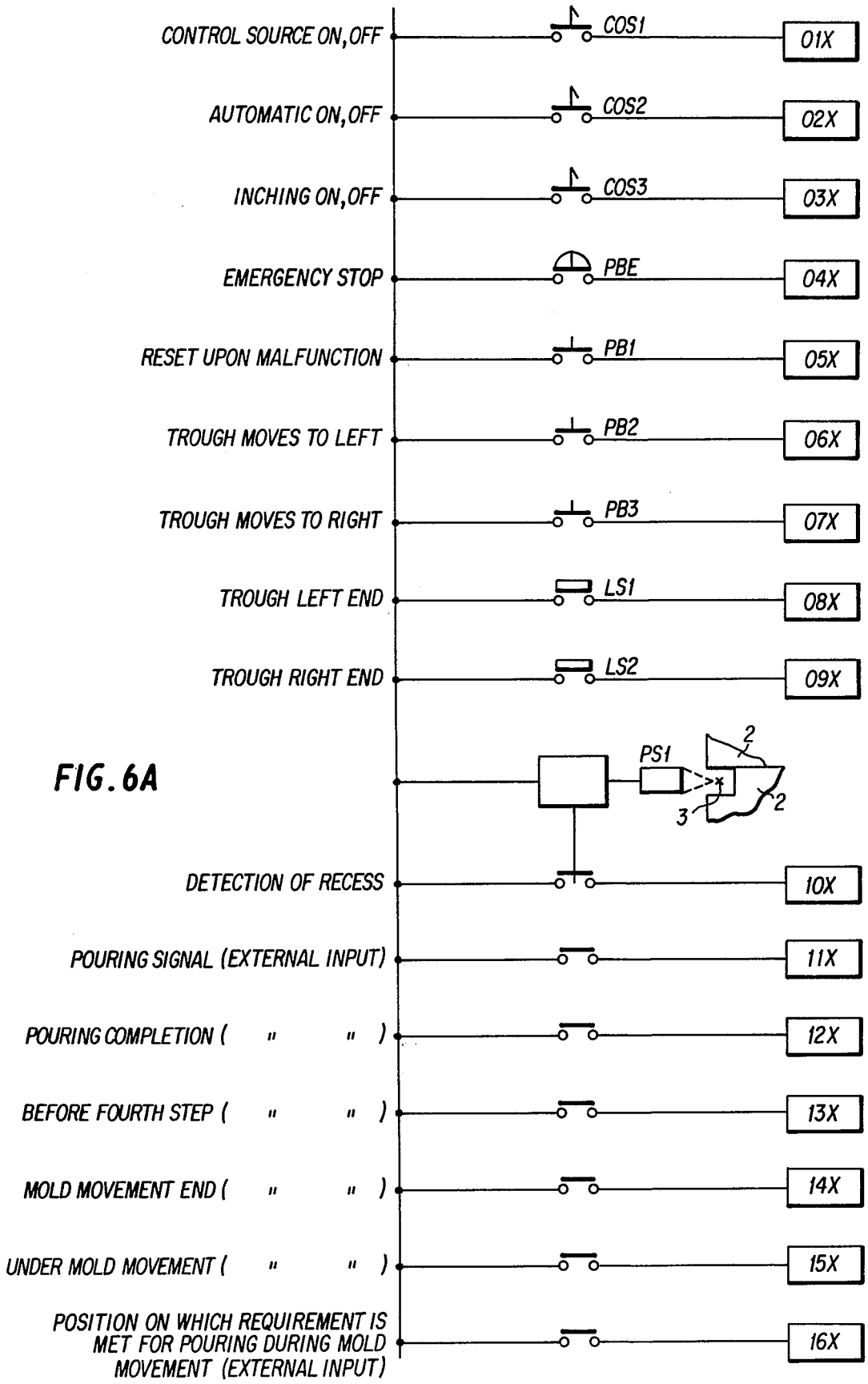
FIGS. 6 to 8 are views showing electrical circuits for controlling detecting operation respectively.
Figure 6B:
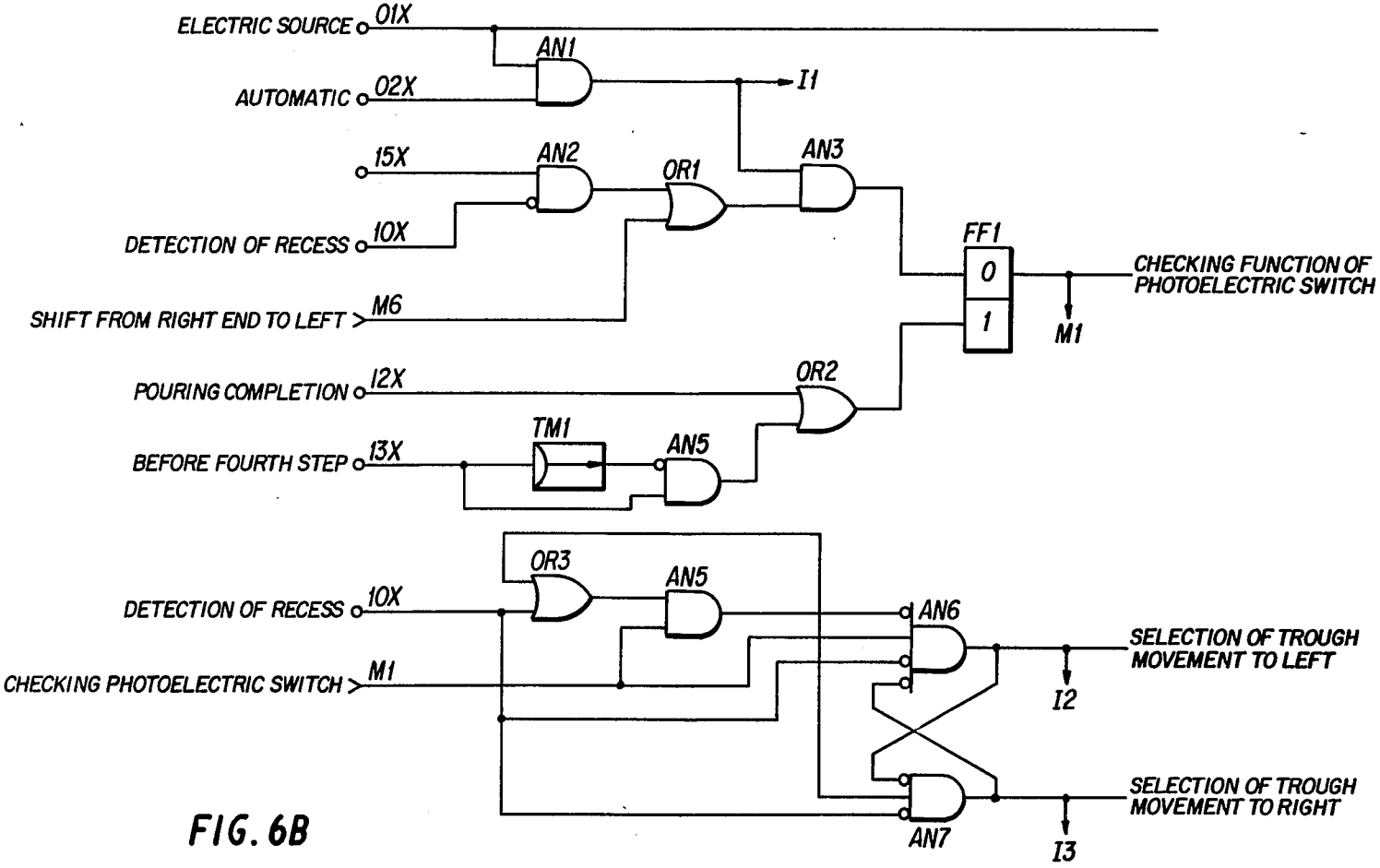
Figure 6C:
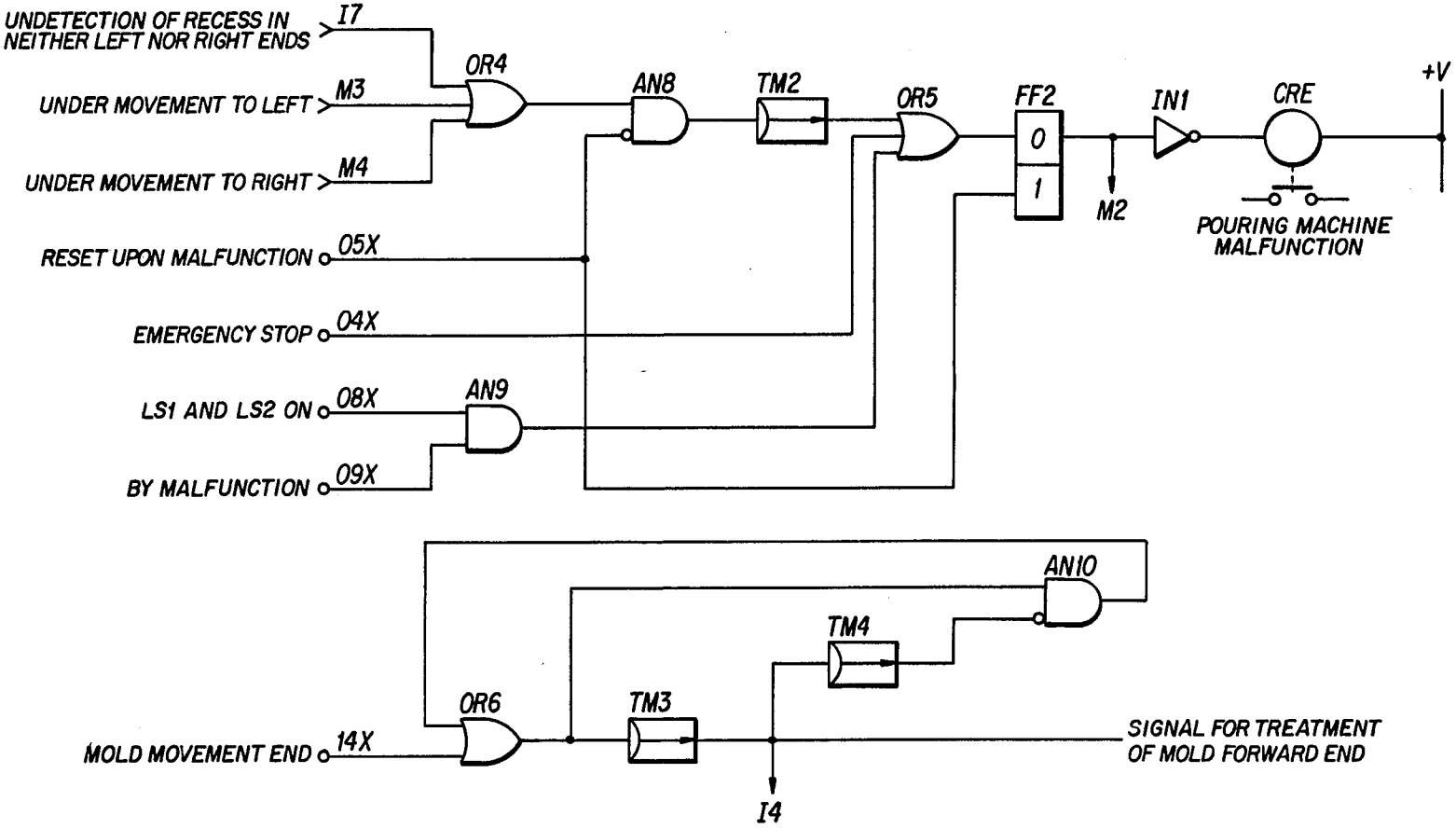
Figure 7A:
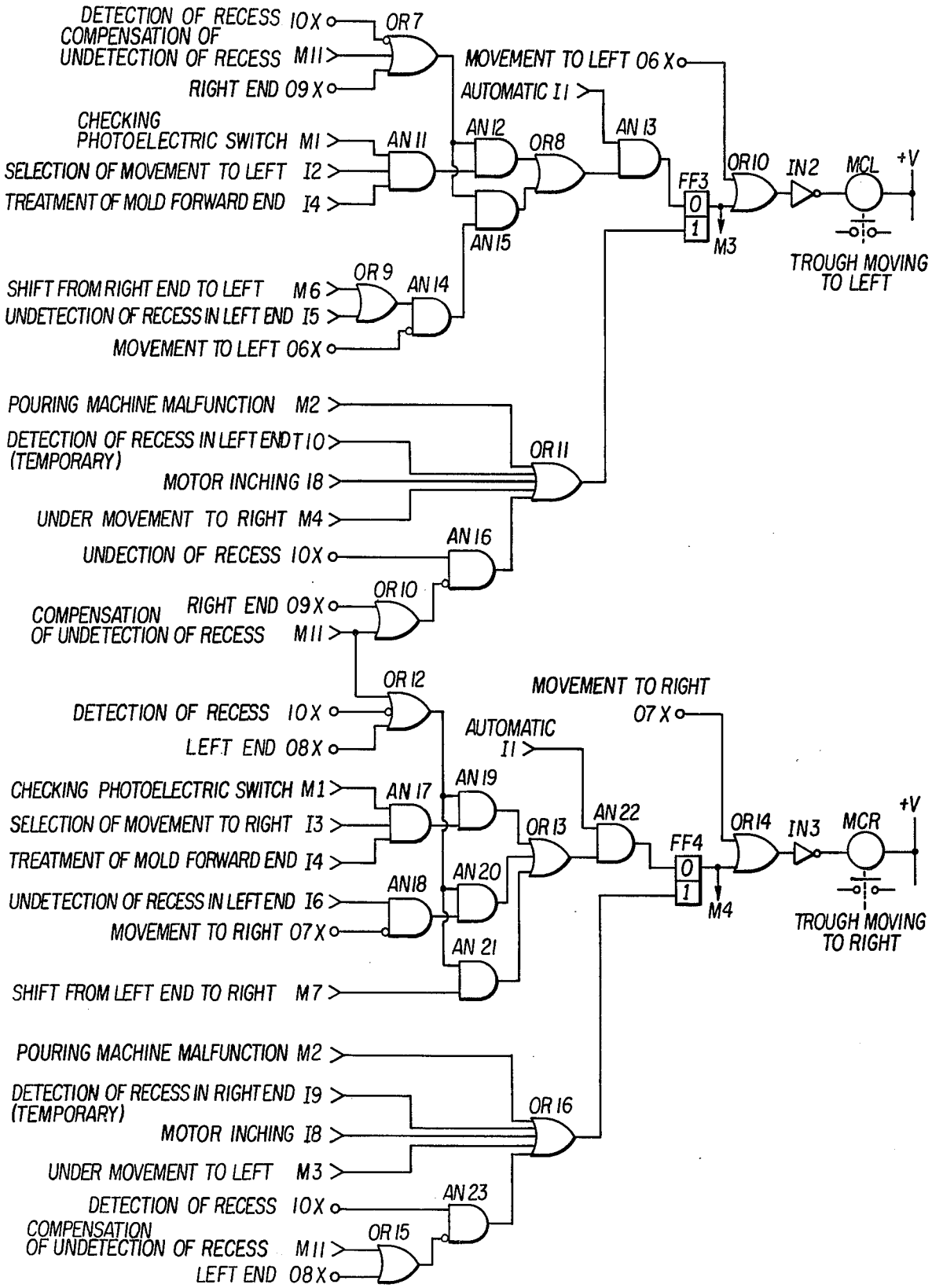
Figure 7B:
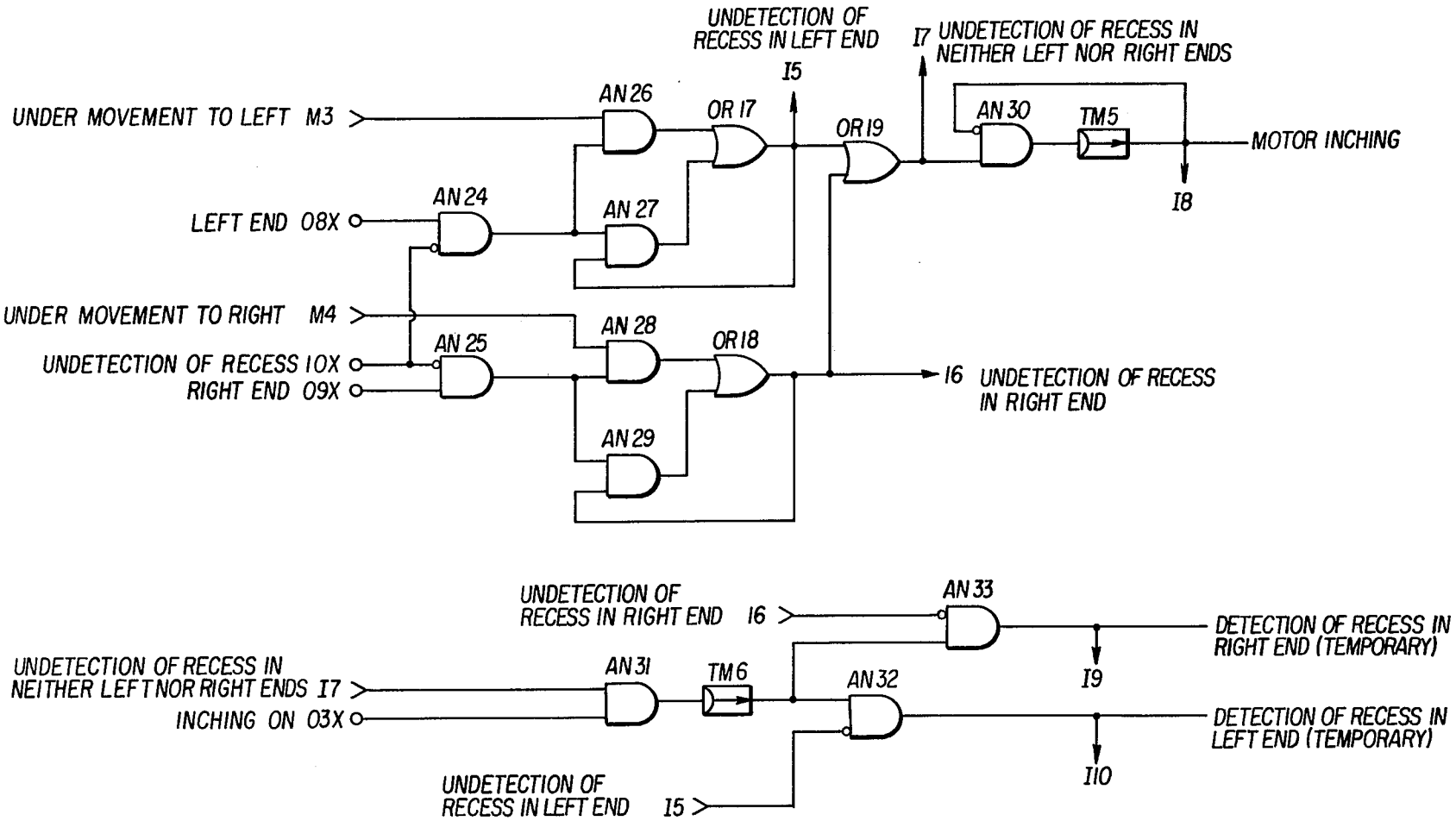
Figure 8A:
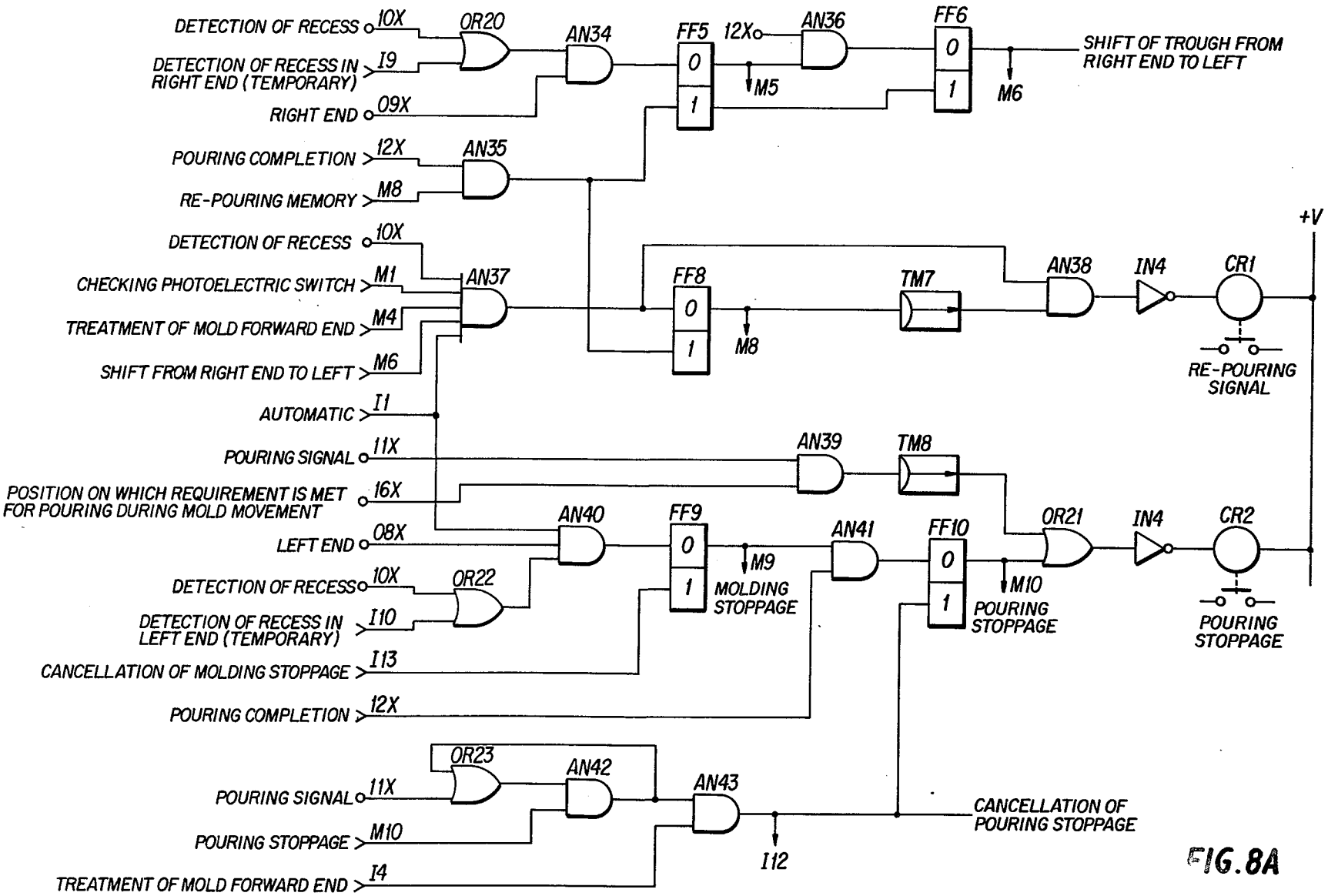
Figure 8B:
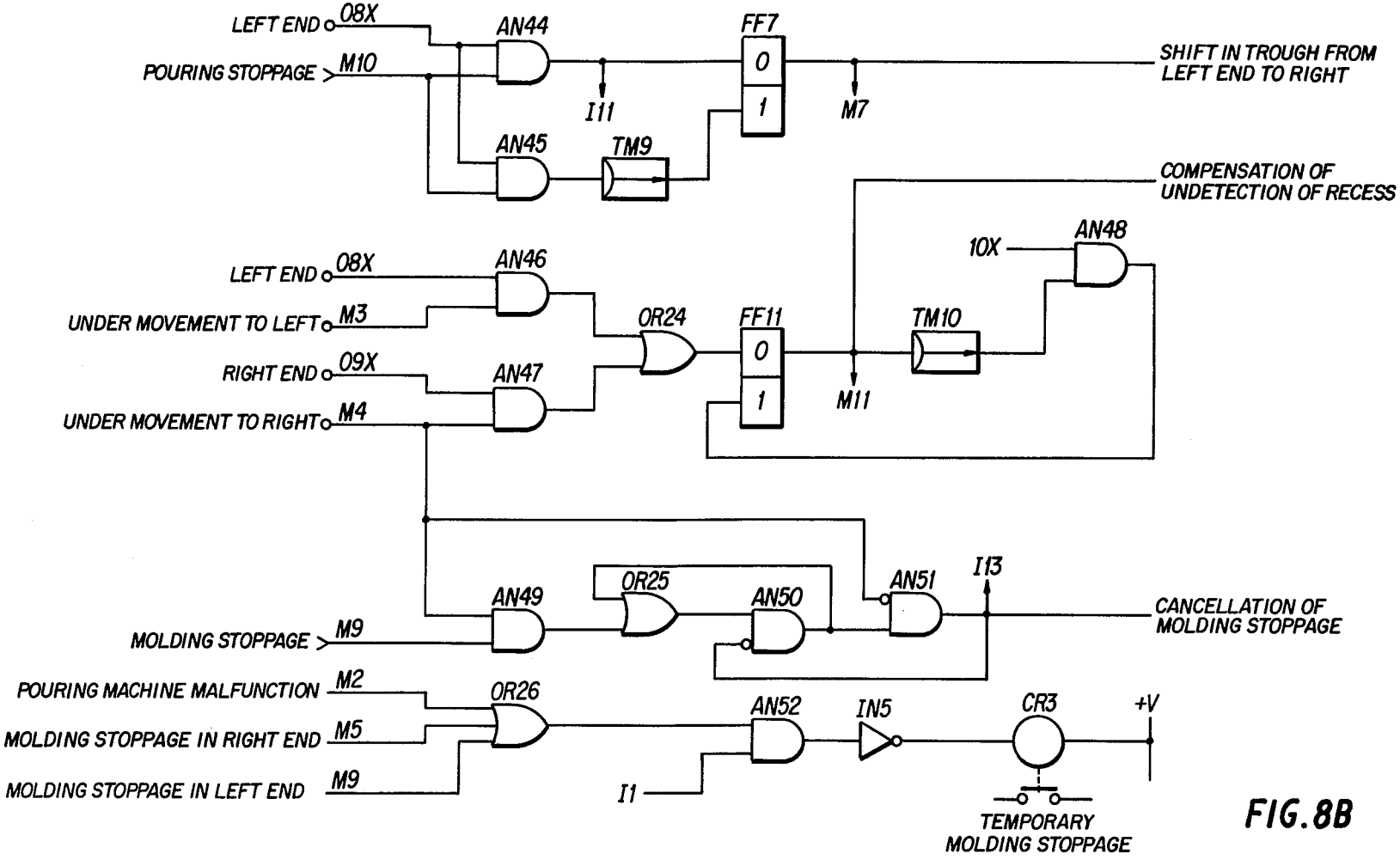

These cases will now be outlined in accordance with the flow chart in FIG. 5 before description is made on operations therein with reference to the electric circuits in FIGS. 6 to 8.

Case I

In starting the pouring machine, the motor M is worked by hand to align the photoelectric switch PS1 with the recess 3 of the first mold 2 in the pouring line. When the pouring machine is operated in this condition, the conveyer is driven to convey the molds 2 in the forward direction, and the function of the photoelectric switch PS1 is automatically checked when the photoelectric switch PS1 becomes off by deviating from the recess 3, and upon checking of the function thereof, a predetermined amount of the molten metal 7 for casting is extruded from the outlet 6 of the body 5 to the trough 8 by a signal from the pouring machine. One pitch conveyance of the mold 2 is completed before the molten metal 7 reaches the spout 9 of the trough 8 so that the molten metal 7 is appropriately poured into the mold 2 through the gate 4. Thereafter another one pitch conveyance of the molds 2 is conducted on the pouring line through the conveyer by a gate signal produced by a detection signal from the photoelectric switch PS1 and a pouring completion signal from the pouring machine, to repeat the aforementioned operation.

Case II

When the recess 3 is detected by the photoelectric switch PS1 before operation of the limit switch LS1 on condition that the recess 3 is not detected upon completion of the one pitch conveyance of the mold 2 in the case I and the motor M is driven to rearwardly move the photoelectric switch PS1 and the trough 8 in the left hand direction in FIG. 1 and start operation to detect the recess 3, the motor M is immediately stopped to stop the trough 8 and the molten metal 7 extruded therefrom reaches the spout 9 to be poured into the mold 2 through the gate 4. Thereafter another one pitch conveyance of the molds 2 is conducted on the pouring line through the conveyer by a gate signal produced by a detection signal from the photoelectric switch PS1 and a pouring completion signal from the pouring machine, to repeat the aforementioned operation.

Case III

Since the recess 3 is not detected by the photoelectric switch PS1 upon operation of the limit switch LS1 in the detecting operation of the case II, the motor M continues to detect the gate 4 temporarily increasing its torque by an inching operation. When the recess 3 is detected before a time which becomes on simultaneously with starting of the inching operation is up, the motor M is immediately stopped to stop the trough 8 and the molten metal 7 extruded in the trough 8 reaches the spout 9 to be poured into the mold 2 through the gate 4. In this case, the trough 8 stops in a position deviating about one pitch of the mold 2 from the center of swinging movement thereof. Therefore, the motor M is reversed by a gate signal produced by a pouring completion signal from the pouring machine and a detection signal from the photoelectric switch PS1 while pouring operation is stopped to forwardly move the trough 8 and the photoelectric switch PS1 toward the center of swinging movement, and after detection of the recess 3 by the photoelectric switch PS1, the motor M is stopped. Since the spout 9 of the trough 8 remains in the position above the gate 4 of the poured mold 2 in this condition, another one pitch conveyance of the molds 2 is conducted on the pouring line through the conveyer simultaneously with stoppage of the motor M upon detection of the recess 3 while pouring operation is stopped. Upon completion of this another one pitch conveyance, stoppage of pouring operation is cancelled and the pouring machine returns to the condition as in the cases I and II, to repeat the aforementioned operation.

Case IV

The timer becomes up without detection of the recess 3 during the inching operation of the motor M as described with respect to the case III. In this case, though the recess 3 is not detected after the timer is up, the spout 9 of the trough 8 is positioned substantially above the gate 4 of the mold 2, and further, the molten metal 7 extruded in the trough 8 reaches the spout 9 to be poured into the mold 4 through the gate 2, and a pouring completion signal is generated from the pouring machine. Thereafter an operation substantially identical with that of the case III is carried out.

Case V

When the recess 3 is detected by the photoelectric switch PS1 before operation of the limit switch LS2 on condition that the recess 3 goes past the photoelectric switch PS1 upon completion of the one pitch conveyance of the mold 2 in the case I and the motor M is driven to forwardly move the photoelectric switch PS1 and the trough 8 in the right hand direction in FIG. 1 and start operation to detect the recess 3, the motor M is immediately stopped to stop the trough 8 and the molten metal 7 extruded in the trough 8 reaches the spout 9 to be poured into the mold 2 through the gate 4. Thereafter another one pitch conveyance of the molds 2 is conducted on the pouring line through the conveyer by a gate signal produced by a pouring completion signal from the pouring machine and the detection signal from the photoelectric switch PS1, to repeat the aforementioned operation.

Case VI

Since the recess 3 is not detected upon operation of the limit switch LS2 in the detecting operation of the case V, the motor M continues to detect the gate 4 temporarily increasing its torque by an inching operation. When the recess 3 is detected before a timer which becomes on simultaneously with starting of the inching operation is up, the motor M is immediately stopped to stop the trough 8 and the molten metal 7 extruded in the trough 8 reaches the spout 9 to be poured into the mold 2 through the gate 4. In this case, the trough 8 stops in a position deviating about one pitch of the mold 2 from the center of swinging movement thereof. Therefore, the motor M is normally rotated by a gate signal produced by a pouring completion signal from the pouring machine and a detection signal from the photoelectric switch PS1 while mold conveyance and a series of molding are stopped to rearwardly move the trough 8 and the photoelectric switch PS1 toward the center of swinging movement, and after detection of the recess 3 by the photoelectric switch PS1, the motor M is stopped.

Since the spout 9 of the trough 8 is in a position above the gate 4 of the unpoured mold 2, a signal for re-pouring is generated during stoppage of molding function including mold conveyance simultaneously with the stoppage of the motor M by detection of the recess 3 while molding operation is stopped to pour the molten metal 7 from the body 5 into the unpoured mold 2. Upon completion of this pouring operation, stoppage of molding is cancelled and the pouring machine returns to the condition as in the cases I, II and V, to conduct another one pitch conveyance of the molds 2 through the conveyer and repeat the aforementioned operation.

Case VII

The timer becomes up without detection of the recess 3 during the inching operation of the motor M as described with respect to the case VI. In this case, though the recess 3 is not detected after the timer is up, the spout 9 of the trough 8 is positioned substantially above the gate 4 of the mold 2, and further, the molten metal 7 extruded in the trough 8 reaches the spout 9 to be poured into the mold 4 through the gate 2, and a pouring completion signal is generated from the pouring machine. Thereafter an operation substantially identical with that of the case VI is carried out.

Detecting operations in the aforementioned cases I to VII as shown in the flow chart of FIG. 5, i.e., detecting operations accompanying with automatic operation of the pouring machine including molding and mold conveyance will now be described with reference to the electric circuits in FIGS. 6 to 8. Elements in the circuits such as flip-flop circuits FF1 to FF11, and circuits AN1 to AN52, or circuits OR1 to OR26, inverters IN1 to IN5, timers TM1 to TM10, relays 01X to 16X, CR1 to CR3 and CRE and electromagnetic switches MCL and MCR will be hereinafter referred to only by the symbols thereof. When input of a reset signal occurs simultaneously with that of a set signal in each of FF1 to FF11, the reset signal takes precedence.

Case I

A push button switch $PB_2$ or $PB_3$ is pushed while a cam switch COS1 for on-off of an electric power source is turned on so that the motor M is normally or reversely rotated through OR10 and MCL or OR14 and MCR to forwardly or rearwardly move the spout 8 and the photoelectric switch PS1 and align the photoelectric switch PS1 with the recess 3 of the first mold 2 in the pouring line 1. In this condition, a cam switch COS3 for on-off of motor inching operation and a cam switch COS2 for automatic on-off are turned on while a controlling circuit (not shown) for the pouring machine is driven to start automatic operation of the pouring machine including molding and mold conveyance. First of all, molding is started and one pitch conveyance of the molds 2 on the pouring line is started through the conveyer, and in this first stage, FF1 is set by an off signal from the photoelectric switch PS1 generated by displacement of the recess 3 from the photoelectric switch PS1, i.e., output zero of 10X, contact of 01X with the electric power source, automatic closing of 02X and output one from 15X during conveyance of the molds 2 so that function of the photoelectric switch PS1 is automatically checked. Thereafter, according to confirmation of a set signal M1 of FF1, a pouring signal 11X is generated from the pouring machine to extrude the molten metal 7 from the body 5 in the trough 8.

When one pitch conveyance of the mold 2 is completed in this condition, output of 14X becomes one, and since output of 10X is one upon completion of the conveyance in this case I, output I2 and I3 of AN6 and AN7 through OR3 and AN5 is zero respectively, and consequently, MCL through FF3 and MCR through FF4 will not operate, leading to reset of FF1 by a pouring completion signal from the pouring machine and restarting of one pitch conveyance of the molds 2 through the conveyer to repeat the aforementioned operation.

Case II

Since the recess 3 does not reach the position aligning with the photoelectric switch PS1 at the point of output one of 14X upon completion of one pitch conveyance as in the case I, output I2 of AN6 becomes one by output zero of 10X and output one of M1. Thus, FF3 is set by output zero of 10X and output one of M1, I2, I4 and I1 and the motor M is driven through MCL to move the travelling chassis 18 in the left hand direction in FIG. 1. This movement of the travelling chassis 18 makes the trough 8 and the supporting arm 12 swing, and by virtue of swinging movement of the supporting arm 12, the detector guiding block 30 slides along the guide bars 29 to move the photoelectric switch PS1 in the left hand direction in FIG. 1 so that the recess 3 is detected before operation of the limit switch LS1 and output of 10X becomes one. As the result, owing to output zero of OR10 by output zero of 09X and M11 and output one of AN16 by output one of 10X, FF3 is reset by output one of 12X upon completion of pouring, and conveyance of the molds 2 through the conveyer is re-started to repeat the aforementioned operation.

Case III

Since the recess 3 does not reach the position aligning with the photoelectric switch PS1 at the point of output one of 14X upon completion of one pitch conveyance similarly with the case II, output I2 of AN6 becomes one by output zero of 10X and output one of M1, and FF3 is set by output zero of 10X and output one of M1, I2, I4 and I1, and the motor M is driven through MCL to move the photoelectric switch PS1 in the left hand direction in FIG. 1. In this case, the recess 3 will not be detected upon operation of the limit switch LS1, and consequently, pulse input I8 from TM5 by output one of M3 and 08X and output zero of 10X enters a reset terminal of FF3 at certain intervals to start inching operation of the motor M. The motor M is not in a regular condition but in a condition temporarilly increasing its torque, and will not be locked by mechanically unnatural movement in the vicinity of the ends of swinging movement of the trough 8 and the supporting arm 12 to move the photoelectric switch PS1 in the left hand direction in FIG. 1, and TM6 starts timing operation by output one of I7 and 03X.

Before TM6 becomes up in this condition, the photoelectric switch PS1 detects the recess 3 to make output of 10X one, and by virtue of output zero of OR10 by output zero of 09X and M11 and output one of AN16 by output one of 10X, FF3 is reset to stop the motor M and complete pouring operation. After pouring operation is completed, output of 12X becomes one and FF1 is reset, and further, by virtue of operation of CR2 through FF9 and FF10 by output one of I1, 08X, 10X and 12X and operation of CR3 by output one of M9 and I1, pouring is stopped regardless of signal for pouring 11X while molding is temporarily stopped. Thereafter the motor M is reversely rotated by operation of MCR through setting of FF4 by output one of M11 before TM10 becomes up after setting of FF11 by output one of 08X and M10 and output one of I1, so that the photoelectric switch PS1 starts moving in the right hand direction in FIG. 1 to again set FF1. Upon detection of the recess 3 of the poured mold 2 by the photoelectric switch PS1, FF4 is reset by output one of 10X, output zero of M11 upon time-up of TM10 and output zero of 08X upon opening of the limit switch LS1 to stop the motor M, and further, output M9 of FF9 becomes zero by I13 of which output has become one by output zero of M4 by output one of M9 and M4, to turn OR3 off. Thus, stoppage of molding is cancelled and another molding operation is started.

Consequently, the molds 2 are forwardly moved on the pouring line 1 while pouring operation is stopped and a pouring signal 11X is given from the molding machine in this condition, though, the molten metal 7 is not immediately extruded from the body 5 by this signal, but upon completion of one pitch conveyance of the molds 2, FF10 is reset by output one of 11X, M10 and I4 to cancel stoppage of pouring operation, and in this condition, a pouring completion signal is given from the pouring machine so that output of 12X becomes one and FF1 is reset to again move the molds 2 in the forward direction and repeat the aforementioned operation.

Case IV

The controlling operation carried out in this case is substantially identical with that in case III except that TM6 becomes up without detection of the recess 3 during the inching operation of the motor M as in the case III, so that output of I10 becomes one and FF9 and FF10 are set simultaneously therewith.

Case V

The controlling operation carried out in this case is substantially identical with that in case II except that upon output one of 14X after completion of one pitch conveyance of the molds 2 as in the case II, the recess 3 goes past the photoelectric switch PS1 and output I3 of AN7 becomes one by output of 10X changing from temporary one to zero so that FF4 is set and the photoelectric switch PS1 is driven by the motor M through MCR to move in the right hand direction in FIG. 1.

Case VI

As in the case V, upon output one of 14X after completion of one pitch conveyance of the molds 2, the recess 3 goes past the photoelectric switch PS1 and consequently output I3 of AN7 becomes one by output zero of 10X and output one of M1 and AN5 and FF4 is set by output zero of 10X and output one of M1, I3, I4 and I1 and the photoelectric switch PS1 is driven by the motor M through MCR to move in the right hand direction in FIG. 1. Since the recess 3 is not detected upon operation of the limit switch LS2 in this case, output I8 is pulsed from TM5 by output one of M4 and 09X and output zero of 10X into the reset terminal of FF4 and simultaneously the motor M starts inching operation. The motor M is not locked and drives the photoelectric switch PS1 to move in the right hand direction in FIG. 1 while TM6 starts timing operation in output one of I7 and 03X.

Before TM6 becomes up in this condition, the photoelectric switch PS1 detects the recess 3 so that output of 10X becomes one, and FF4 is reset by output zero of OR15 owing to output zero of 08X and M11 and output one of AN23 owing to output one of 10X to stop the motor M. Then the pouring operation is completed so that output of 12X becomes one to reset FF1, and CR3 operates by output one of M5 following FF5 and FF6 by output one of 10X, 09X and 12X to temporarily stop molding operation. Then MCL operates through FF3 set by output one of M11 before time-up of TM10 after setting of FF11 by output one of 09X and M4, output one of a signal M6 for setting FF6, output zero of 06X and output one of I1 to reversely rotate the motor M so that the photoelectric switch PS1 starts moving in the left hand direction in FIG. 1 to again set FF1 and thus output of M1 becomes one. Upon detection of the recess 3 of the unpoured mold 2 by the photoelectric switch PS1 in this condition, FF3 is reset by output one of 10X, output zero of M11 owing to time-up of TM10 and output zero of 09X consequent to opening of the limit switch LS2 to stop the motor M. Further, CR1 operates through FF8 set by output one of 10X, M1, M4, M6 and I1 so that re-pouring signal is given while molding operation is stopped to pour the molten metal 7 into the unpoured mold 2. Then FF1, FF5, FF6 and FF8 are reset by output one of 12X and output one of M8 upon completion of pouring operation so that output of M5 becomes zero to cancel temporary stoppage of molding operation while the molds 2 are again moved in the forward direction to repeat the aforementioned operation.

Case VII

The controlling operation carried out in this case is substantially identical with that in case VI except that TM6 becomes up without detection of the recess 3 during the inching operation of the motor M as in the case VI so that output of I9 becomes one to set FF5 and FF6.

Since the pouring signal 11X is given upon confirmation of the function of the photoelectric switch PS1 after setting of FF1 in the embodiments of the present invention, there is few minutes waiting time before the molten metal 7 is actually poured from the spout 9 of the trough 8 into the gate 4 of the mold 2 after the gate 4 is detected. However, such waiting time can be exceedingly decreased by giving the pouring signal 11X of the pouring operation in the pre-pouring step before FF1 is set to increase the operation efficiency. In this case, the pouring operation can be stopped by automatically working CR2 when the mold 2 has not reached a check point 16X corresponding to the position of the next pouring operation after a determined time set in TM8 has been passed upon giving of the pouring signal 11X for extra safety.

Although the present invention has been described with respect to molds produced by a type molding machine, it can also be applied to molds having flasks. Further, a pair of sector gears engaging with each other can be utilized in place of the connecting pin 17 to connect the trough 8 and the supporting arm 12.

While the invention has been described with reference to a preferred embodiment thereof, it is to be understood that modifications or variations may be easily made without departing from the scope of this invention which is defined by the appended claims.

What is claimed is:

1. In an automatic pouring machine for casting located in the vicinity of a horizontal pouring line provided thereon with a plurality of adjacently placed molds intermittently conveyed in one direction and having a pouring trough provided with a spout for pouring molten metal into the gate of each of said molds and horizontally swingable by a vertical pivot, a device for detecting said gate comprising:

a means provided in each of said molds for indicating the position of said gate;

an arm horizontally swingable by a vertical pivot symmetrically provided opposite said pivot of said trough with respect to said pouring line;

a pair of slits provided in ends of said arm and said trough being aligned upon linear alignment of said arm and said trough;

a connecting pin slidably engaged in said slits to move along a perpendicular bisector on a line connecting said pivots with each other;

a detector provided on said arm for detecting said means indicating the position of said gate, the distance between said detector and said connecting pin being identical with that between said connecting pin and said spout of said trough upon linear alignment of said arm and said trough; and a driving means for moving said connecting pin upon receipt of a signal from said detector.

2. The invention as defined in claim 1 wherein said driving means comprises a travelling chassis movable along said perpendicular bisector, a motor for driving said travelling chassis, a chain and a pair of pulleys, and said connecting pin is mounted on said travelling chassis.

3. The invention as defined in claim 1 wherein said detector comprises a guide pin mounted to said arm, a block pushed by said guide pin to move in parallel with said travelling chassis in the same direction therewith upon swinging movement of said arm and a photoelectric switch mounted to said block on a side opposite to said means indicating the position of said gate, and said photoelectric switch functions to detect said means indicating the position of said gate upon facing therewith.

4. The invention as defined in claim 2 wherein said motor of said driving means is connected to an electric circuit which works until said photoelectric switch detects said means indicating the position of said gate and stops working simultaneously with said detection within a range under a predetermined degree of the angle of said swinging movement of said arm upon said linear alignment of said arm and said trough.

5. The invention as defined in claim 4 wherein said motor of said driving means is set to temporarily stop operation when said angle of swinging movement of said arm comes to said determined degree while said means indicating the position of said gate is not detected by said photoelectric switch and to conduct inching operation thereafter.

6. The invention as defined in claim 5 further including a timer operating simultaneously with starting of said inching operation of said motor, and said motor being set to stop operation upon detection of said means indicating the position of said gate be said photoelectric switch before time-up of said timer.

7. The invention as defined in claim 6 wherein said motor is set to stop upon time-up of said timer when said timer becomes up without detection of said means indicating said gate by said photoelectric switch.

* * * * *